US005175440A

United States Patent [19]

Robitschko et al.

[11] Patent Number: 5,175,440

[45] Date of Patent: Dec. 29, 1992

[54] PROCESS FOR CONTROLLING A CENTRAL LOCKING SYSTEM IN A MOTOR VEHICLE AND CENTRAL LOCKING SYSTEM

[75] Inventors: Peter Robitschko, Sindelfingen; Winfried Schreiber, Stuttgart, both of Fed. Rep. of Germany

[73] Assignee: Mercedes-Benz AG, Stuttgart, Fed. Rep. of Germany

[21] Appl. No.: 698,388

[22] Filed: May 10, 1991

[30] Foreign Application Priority Data

May 12, 1990 [DE] Fed. Rep. of Germany ..... 4015268

[51] Int. Cl.[5] ..... E05B 65/36

[52] U.S. Cl. ..... 307/10.1; 70/264; 180/289

[58] Field of Search ..... 307/9.1, 10.1, 10.2; 70/264; 180/289

[56] References Cited

U.S. PATENT DOCUMENTS

| | | | |
|---|---|---|---|
| 4,444,032 | 4/1984 | Stier et al. | 70/264 |
| 4,676,082 | 6/1987 | Huber et al. | 70/264 |
| 4,805,427 | 2/1989 | Bates et al. | 70/264 |
| 4,848,114 | 7/1989 | Rippe | 70/263 |
| 4,848,509 | 7/1989 | Bruhnke et al. | 307/10.2 |
| 5,030,949 | 7/1991 | Reis et al. | 340/825.65 |

FOREIGN PATENT DOCUMENTS

| | | | |
|---|---|---|---|
| 0245001 | 11/1987 | European Pat. Off. . | |
| 3313092 | 4/1980 | Fed. Rep. of Germany . | |
| 3531349 | 7/1980 | Fed. Rep. of Germany . | |
| 2942852 | 5/1981 | Fed. Rep. of Germany . | |
| 3532414 | 11/1986 | Fed. Rep. of Germany . | |
| 3703590 | 7/1988 | Fed. Rep. of Germany . | |
| 3830511 | 5/1989 | Fed. Rep. of Germany . | |
| 0144484 | 6/1990 | Japan | 70/264 |
| 2069587 | 8/1981 | United Kingdom . | |

OTHER PUBLICATIONS

Bedienungsahleitung, Dec. 1986, for Model 190 Series--Mercedes-Benz.

*Primary Examiner*—Jeffrey A. Gaffin

*Attorney, Agent, or Firm*—Evenson, Wands, Edwards, Lenahan & McKeown

[57] ABSTRACT

A process and device for controlling a motor vehicle central locking system that has multiple station operation from the driver's door and from the trunk lid. A central locking of the door locks of the motor vehicle is avoided when mechanically securing the lock of the trunk lid against opening from the outside without a key in the unlocked state. This is done by switch-controlled suppression of the effect of the locking control signal normally generated when locking.

24 Claims, 2 Drawing Sheets

PROCESS FOR CONTROLLING A CENTRAL LOCKING SYSTEM IN A MOTOR VEHICLE AND CENTRAL LOCKING SYSTEM

BACKGROUND AND SUMMARY OF THE INVENTION

The present invention relates to a method and device for controlling a central locking system (CLS) for door locks and hinged lid locks of a motor vehicle that has multiple station operation of the CLS from a first mechanical locking station on a trunk lid and at least one further mechanical locking station on a door. The multiple station operation is performed via a first electrical control switch assigned to the first locking station and at least a second electrical control switch which is assigned to the further locking station, each of the first and second electrical control switches being switchable via the assigned locking station for the generation of unlocking and locking control signals which bring about a corresponding activation of the CLS. The first locking station is movable into a key-secured position by actuation via a key in a locking direction starting from an unlocked position or a neutral key withdrawal position to cause the generation of a locking control signal of the first control switch, which is also actuated when the first locking station is moved into the key-secured position, from which key-secured position the associated lock can only be unlocked again by the key and not by the CLS, the actuation of the first locking station in the locking direction being directed, with respect to the neutral key withdrawal position, in the opposite direction to an actuation of the first locking station in the unlocking direction.

Central locking systems of the above type are known by installation in vehicles manufactured by Mercedes-Benz. "Centrally locking" means locking the multiple locking stations of a vehicle from a single location. The known central locking system offers the advantage to the vehicle user that the lock of the trunk lid, which can be opened from outside without using a key when the lock is unlocked, can be mechanically locked and then remain locked even when the door locks have been unlocked centrally. This is achieved in that the vehicle user turns the lock cylinder on the trunk lid in the locking direction and withdraws the key in a securing position of the lock cylinder (which is always designated below as "key-secured position") which deviates from the neutral key withdrawal position. This possibility is referred to in the operating instructions of the correspondingly equipped vehicles. In German Patent Document DE 35 31 349 C1 also, reference is made to the mechanical lockability of the lock of the trunk lid and its uncoupling from the function of the central locking system brought about thereby in connection with the discussion of the prior art.

However, this undoubtedly desirable securing option can in certain cases reduce the operating convenience of the vehicle due to the central locking which can be controlled at least from the driver's door and the trunk lid via their locking station or lock cylinders. Such a situation arises when the vehicle user wishes to put something in the trunk before starting a journey and, for this purpose, centrally unlocks the vehicle from its locking station. If, after closing the trunk lid, he wishes to lock it with the key in the manner described above, the central locking system is also unavoidably activated in the locking direction via the control switch assigned to the locking station. The vehicle user then finds a locked driver's door and has to unlock it again before getting in and beginning the journey, the other door locks also being centrally unlocked. The trunk lid then remains locked as desired and the contents of the trunk are then protected from unauthorized access even when the door locks are centrally unlocked from the driver's door.

A keyless remote-controllable central locking system (German Patent Document DE 33 13 092 C2), the hand-held transmitters of which can transmit two different code signals, is known. A first receiver in the vehicle controls the central unlocking and locking of all the locks in the usual manner when the first code signal is received. A second receiver is provided in the vehicle which only activates the trunk lid without influencing the door locks when the second code signal is received. The locking of the trunk can then only be canceled after the second code signal is received again at the second receiver.

In addition, central locking systems are known with delayed forwarding of locking pulses (German Patent Documents DE 29 41 899 A1, DE 29 42 852 A1) which permit the vehicle user, after centrally locking his vehicle by means of the driver's door locking station, within a predetermined time period still to open at least the trunk lid before its delayed locking after the expiry of the aforesaid time period.

At this point, it should be noted that with an analogous application of such an embodiment to the present problem a conceivable solution could be provided which, however, remains unsatisfactory because after the expiry of the time period the user who has got into the car would also be locked in involuntarily. For example, it has been suggested in German Patent Document DE 36 12 306 A1 to provide a central locking system with a selection switch arranged in the passenger compartment of the vehicle, by means of which the usual central function of the central locking system can be canceled either only for unlocking or for unlocking and locking. It was also suggested in German Patent Document DE 38 30 511 C1 to provide a central locking system in which, by a single actuation of a locking station provided with a control switch, only the respective lock is unlocked in a purely mechanical way and a central unlocking of all the locks is only possible by means of the repeated actuation of the same closing point.

Finally, a central locking system with multiple station operation is also known (European Patent Document EP 0 245 001 A2), in which different selectable unlocking possibilities are offered (individual unlocking of a lock or central unlocking of all locks) by means of specific, different lock cylinder positions in the same direction. This system also provides that an additional key withdrawal position can be obtained, on a lock on the driver's door, by the key actuation of the lock cylinder in the locking direction. However, this position serves solely for switching on an additional mechanical anti-theft protection which prevents a central unlocking from another point. A key-secured position of a lock which prevents it being unlocked via the central locking system is not disclosed in the European Patent Document.

A known central locking system (German Patent Document DE 35 31 349 C1) mentioned earlier is controlled by bistable selection switches with two fixed contacts connected to different electrical potentials. It has a switching contact, connected via an individual control line to a central control circuit, at each closing point. The control line, one per locking station, always conducts a defined electrical potential and the central control circuit is activated by potential change pulses for the purpose of central unlocking or locking. In this system, a transition from zero potential to negative potential on a control line has no effect on the central control circuit.

Another known central locking system (German Patent Document DE 37 03 590 C1) has a central control circuit with only two control inputs, one for locking control signals, the other for unlocking control signals, to which as many locking or unlocking control switches as desired in the form of push-button switches can be connected via one busbar conductor in each case. These push-button switches are assigned in pairs also to the locking stations for the operation of the central locking system and are briefly actuated by pulses by correspondingly directed swivelling of the key in these locking stations.

An object of the invention is to provide a process for controlling a central locking system with which the above-mentioned inconvenience of "unavoidable central locking of all the locks when the lock of the trunk lid is locked by key" can be avoided in a simple way, and to provide a central locking system of the generic type with means by which the vehicle user does not have to unlock the door lock of the vehicle again after moving the locking station of the trunk lid or of the corresponding lock into the key-secured position if he subsequently wishes to get into the vehicle.

This and other objects are achieved by the present invention which provides a method for controlling a central locking system (CLS) for door locks and hinged lid locks of a motor vehicle that has multiple operation of the CLS from a first mechanical locking station on a trunk lid and at least one further mechanical locking station on a door. The multiple station operation is performed via a first electrical control switch assigned to the first locking station and at least a second electrical control switch which is assigned to the further locking station, each of the first and second electrical control switches being switchable via the assigned closing point for the generation of unlocking and locking control signals which bring about a corresponding activation of the CLS. The first locking station is movable into a key-secured position by actuation via a key in a locking direction starting from an unlocked position or a neutral key withdrawal position to cause the generation of a locking control signal of the first control switch, which is also actuated when the first closing point is moved into the key-secured position, from which key-secured position the associated lock can only be unlocked again by the key and not by the CLS, the actuation of the first locking station in the locking direction being directed, with respect to the neutral key withdrawal position, in the opposite direction to an actuation of the first locking station in the unlocking direction. The method includes triggering a switching operation at an electrical switch assigned to the first locking station when the first locking station is actuated by the key in the unlocking direction, and at least indirectly suppressing the effect of the locking control signal of the first control switch, which is also actuated when the first locking station is subsequently moved into the key-secured position, via a switching device cooperating with the electrical switch during the switching operation.

The objects of the invention are also achieved by the present invention which provides a central locking system (CLS) for motor vehicle door and trunk locks with multiple station operation, and comprises a locking station of a trunk lid and at least one additional locking station, each locking station having at least one control switch which can be switched via actuation by a key. The locking station of the trunk lid also has an associated lock and a closing cylinder movable via a key into a secured, locked position starting from a neutral key withdrawal position, in which secured, locked position the associated lock can only be unlocked by the key and not by the CLS. The system has a central control circuit, coupled to the locking station of the trunk lid and the additional locking station, which has inputs to which unlocking and locking control signals of the control switches are applied. The central control circuit at least indirectly activates lock actuators of the CLS in accordance with the locking and unlocking control signals. An electrical switch is provides that is coupled to the first locking station and which can be switched when the first locking station is actuated in the unlocking direction. There is also a switching device which can be activated at least indirectly by the electrical switch and which, after being activated, suppresses at least for a limited period the effect in the central control circuit of the locking control signal generated by the control switch of the locking station of the trunk lid.

With a central locking system modified according to the present invention, the vehicle user can avoid a central locking of the locks of his vehicle when locking the trunk lid by key in that he initially once more actuates the associated unlocked lock point or the closing cylinder with his key in the unlocking direction. A switching operation is then triggered or a switch is then actuated, and the locking station, preferably within a predetermined time period, is then moved in the usual manner into the position which is locked by mechanical or "secured" means.

By means of a detectable electrical switching signal of the actuated switch, a switching device can be activated which cancels or suppresses the effect on the central control circuit of the central locking system of the locking control signal, generated during locking, of the control switch assigned to the locking station of the trunk lid.

On the other hand, the switching operation of the switch can be utilized, even without the generation of a detectable electrical switching signal, for the desired suppression of the effect of the locking control signal if the switch is looped directly into the associated control line with its switching contact and is opened during the switching operation. The switch has to be then closed again at the latest when the key-secured position is reached, in order to restore the usual mode of operation of the central locking system.

With the present invention, all the normal functions of the central locking system are retained, in an advantageous manner, in their entirety. In particular, it is still possible to centrally unlock and to lock all the locks on the vehicle from the locking station of the trunk lid.

The process according to the invention can be carried out with both control principles.

Other objects, advantages and novel features of the present invention will become apparent from the following detailed description of the invention when considered in conjunction with the accompanying drawings.

DETAILED DESCRIPTION OF THE DRAWINGS

Figure 1:
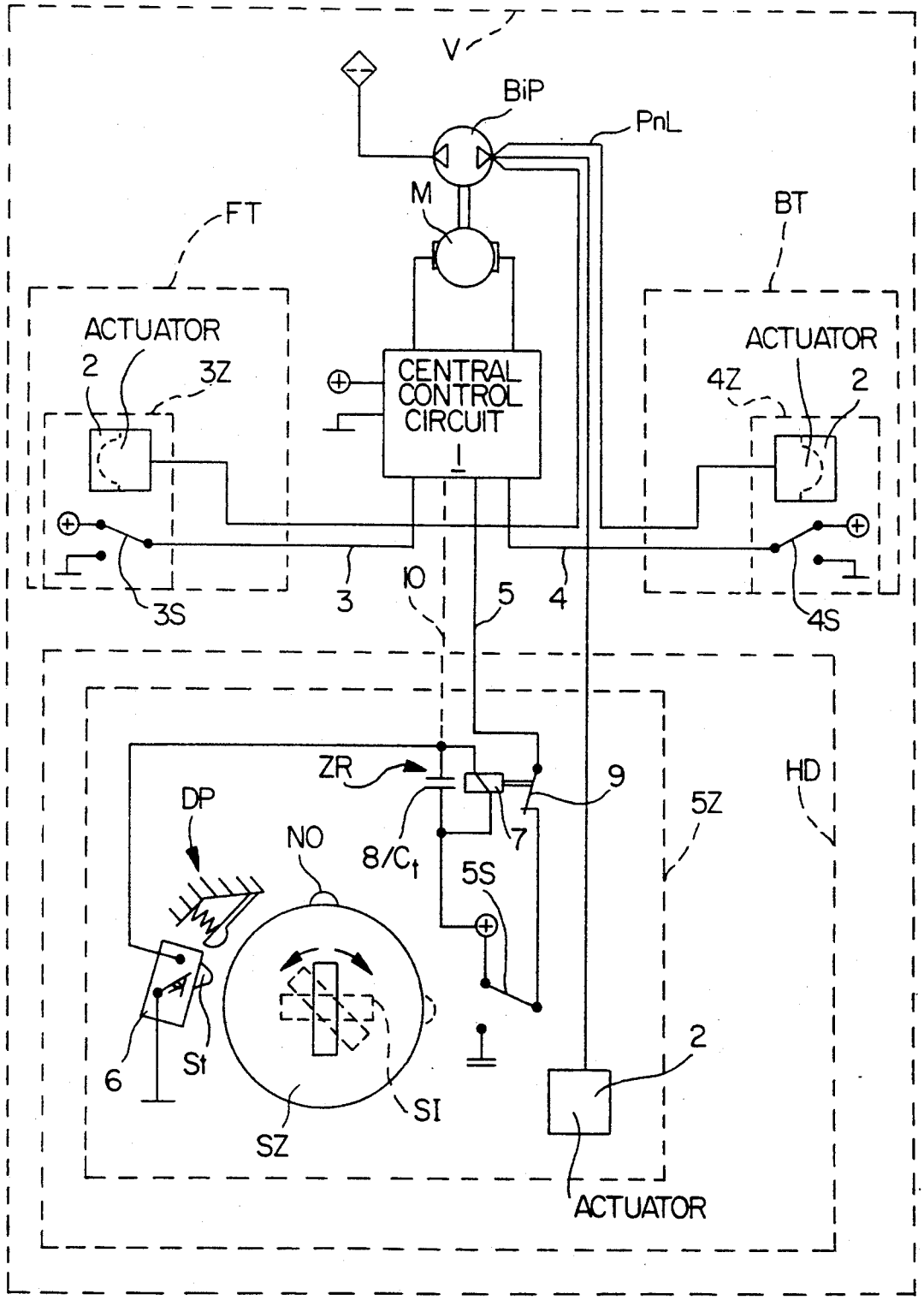
FIG. 1 shows a circuit diagram of a central locking system with a first control switch arrangement constructed in accordance with an embodiment of the present invention.

The central locking system in FIG. 1 has a central control circuit with electrical voltage supply which can operate pneumatic membrane piston actuators 2 (only indicated diagrammatically) by means of a reversible electrical motor M and a dual-pressure pump BiP which can be driven by the motor M and is connected to the actuators 2 via one hose line PnL in each case.

Three bistable control switches 3S, 4S and 5S are assigned in this sequence in each case to a mechanical locking station, 3Z on the driver's door Ft, 4Z on the front seat passenger door BT and 5Z on the trunk lid HD of a vehicle V. Each of the locking stations 3Z, 4Z and 5Z is mechanically coupled in a known manner to a lock (not illustrated here in greater detail) or to its locking lever by means of a loose connection so that the lever is mechanically unlocked or locked if the associated locking station is correspondingly actuated by a suitable key.

By means of the loose connection it is ensured that every locking station, which usually contains a mechanically coded lock cylinder, can be moved into a neutral key withdrawal position in which the associated lock can be unlocked or locked, irrespective of the locking station, by means of the actuator which is also coupled mechanically to the lock or to its locking lever. The locking station on the trunk lid also has a handle (not illustrated) for opening the lock without a key manually and from the outside when it is already unlocked. The handle can be provided in a known manner, e.g. in the form of an insertable lock cylinder or a corresponding lever handle. In the key-secured state of the lock, the handle can either be released or blocked.

The control switches 3S, 4S and 5S are all of the same design having in each case one switching contact connected to the respective control line and two fixed contacts connected to opposite electrical potentials (positive/negative). When actuating one of the locking stations 3Z, 4Z, 5Z by means of a key, starting from the neutral key withdrawal position, in the unlocking direction, the associated control switch 3S, 4S, 5S is changed over from negative to positive, and vice versa when this locking station is actuated by means of a key in the locking direction, starting from the neutral key withdrawal position, unless the switch is already in the corresponding position after the key had already been previously swivelled in the same direction.

The switching contact of each of the control switches 3S, 4S and 5S is connected via a control line 3, 4 or 5 to the central control circuit 1. Any change in potential on one of the control lines from positive to negative when actuating by key the corresponding locking station brings about the activation of the central control circuit 1 in a known manner for the purpose of operating the actuators in the locking direction. Opposite changes in potential, from negative to positive, activates the central control circuit for the purpose of operating the actuators in the unlocking direction. In the control switches there are provided dead center springs (not illustrated) which ensure that the control switches always assume one of two end positions and can only be switched in a snap-over manner.

The respective non-key-actuated control switches are also adjusted in a manner not shown in greater detail in the course of the respective operating cycle of the central locking system by the respective actuators. The resulting changes in potential in the same direction have no switching effect, so that generally all the control switches are in the same position in the state of rest and correspondingly all the control lines 3, 4 and 5 conduct the same electrical potential.

For safety reasons, during a possible change in potential from "potential-free" to negative the central control circuit 1 must not be activated for the purpose of operating the actuators in the direction of locking. Otherwise, for example when working on the disconnected vehicle battery and when the doors are closed after reconnecting the battery, an automatic central locking could occur if the switching contact of one of the control switches happens to rest against the fixed contact connected to negative potential.

In the closing point 5Z of the trunk lid HD, the keyhole side of a lock cylinder SZ is also illustrated in the neutral key withdrawal position. In a known manner, the closing cylinder SZ has an additional, key-secured position SI (shown by dashed lines) in which the key can be withdrawn in a deviation from the normal neutral key withdrawal position after swivelling about 90° in the locking direction (to the right, as indicated by a small arrow). In this position, for example, the associated lock (not illustrated) is locked and blocked mechanically in such a way that the actuator 2 provided here cannot unlock the lock. With the pneumatic actuators used, this is possible very easily by mechanical blocking; although the actuator is impinged on with unlocking overpressure, it cannot move. It is also possible to disconnect the supply(s) to the corresponding actuator 2 in the key-secured position of the locking station 5Z so that the actuator 2 simply cannot be operated.

However, the control line 5 conducts negative potential also in the key-secured position of the lock cylinder SZ. In other words, in order to reach the key-secured position starting from the unlocked state of the lock associated with the locking station 5Z (the normal unlocking position which can be reached by swivelling to the left the lock cylinder SZ through approximately 45° is shown by dot-dash lines) or also from the neutral key withdrawal position in which the lock can of course also be locked, the potential on this control line changes from positive to negative with the above-described effect of a locking control signal.

A further switch 6, implemented as a push-button switch, is provided in the locking station 5Z and can be switched solely when the locking station 5Z is actuated or when the lock cylinder SZ is swivelled in the unlocking direction.

The switch 6 is actuated by a cam NO arranged on the lock cylinder SZ. This cam NO corresponds to a switching tappet St of the switch 6. When the lock cylinder SZ swivels in the unlocking direction, the cam NO first runs up against a pressurizable notch DP which forms a clear pressure point. The switching point of the control switch 5S in the unlocking direction, a change in potential from negative to positive, lies ahead of the point where the cam NO runs up against the notch so that it is certain that the switch 6 does not respond until after the control switch 5S. The vehicle user must therefore intentionally swivel the locking station 5Z for the actuation of the switch 6 beyond the usual swivelling area (shown by dot-dash lines).

The electrical effect of the actuation of the switch 6 is illustrated by a timing relay ZR which contains a relay coil 7, a capacitor 8 connected in parallel to the relay coil 7 as a timing element $C_t$ and a break contact 9 which can be switched by the relay coil 7 and is looped into the control line 5 between the control switch 5S and the central control circuit 1. In the illustrated embodiment, the push-button switch 6 is connected to negative potential (vehicle ground) and also to the timing relay ZR which is itself connected to positive potential.

In the non-actuated state of the switch 6, the capacitor 8 is neutral or positive on both sides. As soon as the switch 6 is closed, the relay coil 7 is activated, the break contact 9 is opened and the capacitor 8 is charged or negative on the switch side. If the switch 6 is then opened again, the compensating or discharge current of the capacitor flows across the relay coil 7 so that the break contact remains open for the discharge time constant of the capacitor 8 and the control line 5 is switched free of potential. Of course, the capacitor 8 is sufficiently dimensioned to be able to activate the relay coil 7 for long enough with its discharge current. Alternatively, the timing element $C_t$ can of course also be implemented by electronic means (counter, holding element).

If, during the time period predetermined by the time constant of the timing element $C_t$ and started by the closing actuation of the push-button switch 6, the control switch 5S changes its potential from positive to negative, this change in potential in the central control circuit 1 remains without effect due to the interrupted and thus potential-free control line 5. Even if the break contact 9 is ultimately closed again after the time period expires, the central control circuit 1 cannot be activated as a result of this to operate the actuators in the looking direction due to the already mentioned safety measure, because, when this time period expires, the central control circuit 1 is only fed via the control line 5 with potential changes from positive to "potential-free" and from there to negative.

This means that the vehicle user is now provided with means of mechanically securing the trunk lid after actuation of the switch 6 (position SI of the lock cylinder SZ) without at the same time centrally locking all the other locks and without having to hurry to get into the vehicle. The intentional actuation of the switch 6, which is only possible by overcoming the notch DP, secures the system even against misunderstandings to the greatest possible extent. The switch 6 is in fact not actuated so that any change in potential of the control switch 5S continues to be processed in the usual manner, as already mentioned, in the central control circuit 1.

A different switching possibility for achieving the same effect is indicated by a dashed line 10. This line 10 could signal the actuation of the switch 6 directly to the central control circuit instead of the timing relay ZR or of an equivalent timing element including the break contact 9. By means of a program change or corresponding hardware measures in the electronic central control circuit it can also be achieved, for example by simulation of an internal potential-free switching of the input of the control line 5 for a limited period after the reception of the signal of the switch 6, that when securing the lock of the trunk lid HD by key the other locks are not also centrally locked.

Figure 2:
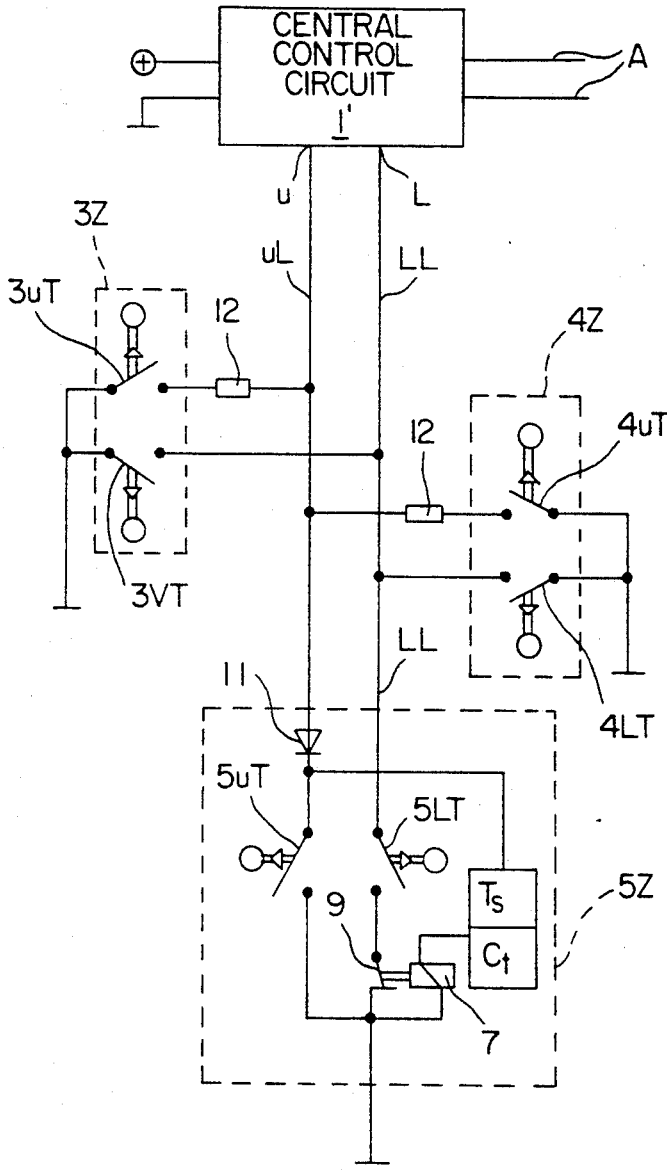
FIG. 2 shows a circuit diagram of a central locking system with a different control switch arrangement constructed in accordance with another embodiment of the present invention.

A further advantageous embodiment is illustrated diagrammatically in FIG. 2 with reference to a central locking system provided with a different control switch arrangement. The illustration of the vehicle and of the doors/hinged lids are not provided in this figure; only the locking stations 3Z (driver's door), 4Z (front seat passenger door) and 5Z (trunk lid) are indicated. A central control circuit 1' here has, in a known manner, only two control inputs U (unlocking) and L (locking) as well as two electrical outputs A for the reversing operation of pneumatic or electrical actuators analogously to the illustration in FIG. 1. An unlocking control line UL is connected to the input U and a locking control line LL is connected to the input L of the central control circuit 1'. In every locking station 3Z, 4Z and 5Z an unlocking control switch 3UT 4UT and 5UT and a locking control switch 3LT, 4LT and 5LT are provided. All the control switches are designed as self-resetting and cam-actuatable single-pole push-button switches and are connected according to their function to the unlocking control line UL or to the locking control line LL and also to negative potential (vehicle ground). These control switch combinations can also be considered to be uniform control switches in the form of equivalent selection keys 3UT/3LT etc. with neutral central position or be replaced by such keys.

Depending on the direction of actuation of one of the locking stations, which here again also have a lock cylinder with neutral key withdrawal position, the respectively assigned unlocking or locking control switch is closed in the unlocking or locking direction for at least a short time via cams or the like. However, the locking control switch 5LT of the locking station 5Z is not continuously actuated in the key-secured position (SI, FIG. 1) of the locking station 5Z but rather only temporarily when the locking station is moved into this position.

With this control switch configuration an additional switch (push-button switch), which would be comparable with the switch 6 from FIG. 1, for the execution of the additional function according to the invention can be dispensed with in that the unlocking control switch 5UT additionally assumes its function. A diode 11 which permits a flow of current only into the closing point is connected into the unlocking control line UL upstream of the control switch 5UT. Resistors 12 which have the same ohmic resistance as the diode are connected to the corresponding terminals of the control switches 3UT and 4UT, so that, irrespective of which locking station is actuated, the same unlocking control currents always flow via the unlocking control line UL.

Between the diodes 11 and the control switch 5UT, a timing element $C_t$ which has a switch-on-delaying input stage $T_S$ is connected to the unlocking control line UL. On the output side, a relay coil 7 is in turn connected with a break contact 9 to the timing element, the break contact 9 being connected into the locking control line LL downstream of the locking control switch 5LT. The break contact 9 could also be connected into the line LL in a different point in another embodiment or be replaced by a correspondingly controllable inhibiting circuit inside the central control circuit 1'. The diode 11 prevents the timing element $C_t$ from being started from a different closing point.

When the control switch 5UL is open and not actuated, there is constantly a certain positive voltage level applied to the input stage $T_S$ of the timing element $C_t$ via the unlocking control line EL. The input stage $T_S$ only permits the time period predetermined by the timing constant of the timing element to be started if the positive voltage level is reduced for a certain period, that is to say if the control switch 5ET is kept closed during this time period. The time period is preferably about one second. This measure is an equivalent replacement of the mechanical notch or pressure point arrangement DP in FIG. 1 and secures the operation of this central locking system from the locking station of the trunk lid against misunderstandings to the greatest possible extent because, during the normal operation of the locking station, only a short swivelling of the key in the unlocking direction is required to generate the unlocking control signal. There is thus no risk of the vehicle user leaving the doors of the vehicle unlocked after "normal" central locking of his vehicle from the locking station of the trunk lid.

The measure is realized mechanically in that the lock cylinder of the locking station 5Z can be swivelled in the unlocking direction against a stop by means of the key, in which position the control switch 5UT is then kept closed.

If the timing element $C_t$ is then started, the break contact 9 is opened and disconnects the control line LL for the duration of the timing constants of the timing element $C_t$. A switching pulse of the locking control switch 5VT generated during this time period, for example when moving the locking station 5Z into its key-secured position, can consequently not be detected by the central control circuit 1'.

Thus, in this way too, the vehicle user is provided with means of mechanically securing the trunk lid after the actuation of its locking station in the unlocking direction (position SI of the lock cylinder SZ in accordance with FIG. 1), without at the same time centrally locking all the other locks. The necessity of keeping to the start timing constants of the input stage $T_S$ also secures this system to the greatest possible extent against error. If they are not kept, each actuation of each switching pulse of the locking control switch 5LT continues to be processed in the usual manner and with the expected effect in the central control circuit 1'.

In contemplated embodiments, in the control switch configuration shown in FIG. 2 an additional switch could also be provided, analogously to switch 6 in FIG. 1, with a notch for starting the timing element, which would then however have to be switched on without a delay.

Figure 3:
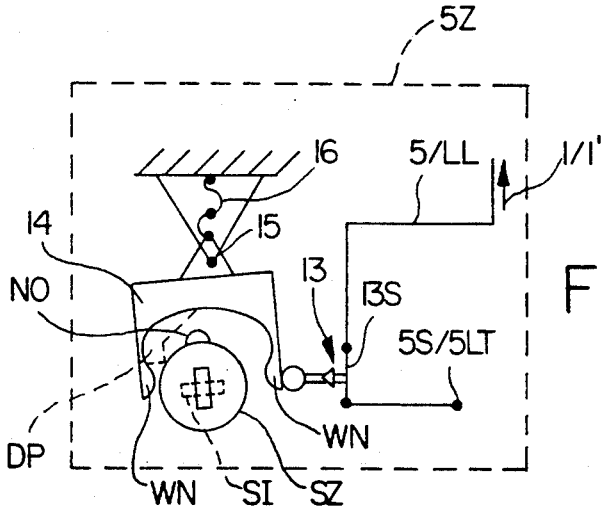
FIG. 3 shows a purely mechanical variant of a trunk lid locking station modified in accordance with the present invention.

A third embodiment is illustrated in FIG. 3, which, in a simple manner, fulfills the same purpose of "non-locking" of the other locks during the mechanical securing of the trunk lid lock as the two exemplary embodiments shown. This embodiment is realized by means of a disconnector switch 13, the single-pole switching contact 13S of which is connected into the control line 5 according to FIG. 1 or into the locking control line LL according to FIG. 2. This contact 13S is opened by swivelling the lock cylinder SZ of the locking station 5Z of the trunk lid in the unlocking direction as far as a stop, possibly also after overcoming a pressure point (notch DP), beyond the normal unlocking position by means of an engageable actuation device, with a switching operation being triggered without generating a detectable electrical signal. The contact 13S is closed again after moving the closing cylinder into the key-secured position or only after pulling out the key in this position, the engagement device being disengaged again.

The engagement device can be designed in an analogous way to the engagement, for example, of ballpoint pen refills or the like and actuated by means of cams or radial cams connected to the lock cylinder. For purposes of exemplary illustration, the engagement device is embodied in FIG. 3 by a rocker 14 with a pivot bearing 15 and a dead center spring 16. The dead center spring 16 engages on the rocker 14 eccentrically with respect to the pivot bearing 15 and permits only two stable final positions. In one of these final positions, the illustrated normal position, the disconnector switch 13, which is designed as a normally closed contact switch, is closed and in the other final position it is opened.

The approximately U-shaped rocker 14 encloses between its legs a part of the lock cylinder SZ provided with a cam NO or encloses another component, for example a lock nut, which is provided with the cam NO and is coupled fixed in terms of rotation to the lock cylinder SZ. At the free ends of its legs, the rocker 14 is provided with formed-on inwardly pointing rocker cams WN which correspond to the cam NO. By swivelling the lock cylinder SZ in the unlocking direction beyond the notch DP, and thus further than is normally necessary for unlocking and controlling the central locking system, the rocker 14 is moved around by the cam NO and the left-hand rocker cam WN, in which case the disconnector switch 13 is opened. The control line 5 or LL is thus disconnected. The cam NO does not strike the right-hand rocker cam WN and move the rocker around again into the illustrated position until the key-secured position of the lock cylinder SZ or of the locking station 5Z and of the associated lock is reached. In this case the disconnector switch 13 is closed again and the connection between the control switch 5S and the central control circuit 1 (FIG. 1) or between 5LT and the central control circuit 1' (FIG. 2) is restored. The locking control signal of the respective control switch which has been generated in the meantime remains without effect here too. With the mechanical variant described above a disconnection of the control line until the key-secured position of the lock point or of the lock cylinder is reached is thus ensured. Of course, with such a purely mechanical disconnector arrangement, no timing element whatsoever has to be provided and the vehicle user does not have to keep a time period between the disconnection of the respective control line and the moving of the locking station into the key-secured position.

If, for the lock of the trunk lid, there is the possibility of mounting the disconnector switch in a dry space sealed against wetness or dampness, the rocker or a corresponding mechanical arrangement can itself bear or form the movable contact of the switch, and the corresponding fixed contact can then be attached directly to a carrier of the disconnector switch.

In the interest of an undisrupted functioning of the control of the central locking system, it is clear that in all the embodiments illustrated only the effect of a locking control signal of the control switch assigned to the locking station actuated in the locking direction and also actuated is suppressed but not the generation of the signal per se.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A method of controlling a central locking system (CLS) for door locks and hinged lid locks of a motor vehicle that has multiple station operation of the CLS from a first mechanical locking station on a trunk lid and from at least one further mechanical locking station on a door, the multiple station operation being performed via a first electrical control switch assigned to the first locking station and at least a second electrical control switch which is assigned to the further locking station, each of the first and second electrical control switches being switchable via a respective locking station for the generation of unlocking and locking control signals which bring about a corresponding activation of the CLS, the first locking station being movable into a key-secured position by actuation via a key in a locking direction starting from an unlocked position or a neutral key withdrawal position to cause the generation of a locking control signal of the first control switch, the first control switch also being actuated when the first locking station is moved into the key-secured position, the associated lock being unlockable again by the key and not by the CLS from the key-secured position, the actuation of the first closing point in the locking direction being direction, with respect to the neutral key withdrawal position, in the opposite direction to an actuation of the first locking station in the unlocking direction, the method comprising:

triggering a switching operation at an electrical switch assigned to the first locking station when the first locking station is actuated by the key in the unlocking direction;

at least indirectly suppressing the effect of the locking control signal of the first control switch, which is also actuated when the first locking station is subsequently moved into the key-secured position, via a switching device cooperating with said electrical switch during the switching operation.

2. The method according to claim 1, wherein the step of triggering of the switching operation occurs only upon actuation of a key at the first locking station in the unlocking direction beyond an unlocking switching point of the first control switch.

3. The method according to claim 2, further comprising generating a detectable electrical switching signal of the electrical switch by the triggered switching operation, and wherein the step of suppressing the effect of the locking control signal of the first control switch by the switching device which can be activated by the electrical switching signal is performed only within a predetermined time period directly following the generation of the switching signal.

4. The method according to claim 3, wherein the switching device is activated only after generation of the switching signal extends over a predetermined time period.

5. The method of claim 2, further comprising:

opening of the electrical switch, which is coupled with a switching contact directly into an associated control line for the transmission of the locking control signal, said opening being accomplished via actuation of the first locking station in the unlocking direction starting from the neutral key withdrawal position; and reclosing of the electrical switch only after the key-secured position of the first locking station is reached.

6. The method of claim 1, further comprising:

opening of the electrical switch, which is coupled with a switching contact directly into an associated control line for the transmission of the locking control signal, said opening being accomplished via actuation of the first locking station in the unlocking direction starting from the neutral key withdrawal position; and reclosing of the electrical switch only after the key-secured position of the first locking station is reached.

7. The method according to claim 1, further comprising generating a detectable electrical switching signal of the electrical switch by the triggered switching operation, and wherein the step of suppressing the effect of the locking control signal of the first control switch by the switching device which can be activated by the electrical switching signal is performed only within a predetermined time period directly following the generation of the switching signal.

8. The method according to claim 7, wherein the switching device is activated only after generation of the switching signal extends over a predetermined time period.

9. A central locking system (CLS) for motor vehicle door and trunk locks with multiple station operation, comprising:

a first locking station of a trunk lid and at least a second locking station, each locking station having at least one control switch which can be switched via actuation by a key, the first locking station also having an associated lock and a lock cylinder movable via a key into a key-secured position starting from a neutral key withdrawal position, in which key-secured position the associated lock can only be unlocked by the key and not by the CLS;

a central control circuit, coupled to the first locking station and the second locking station, and having inputs to which unlocking and locking control signals of the control switches are applied, said central control circuit at least indirectly activating lock actuators of the CLS in accordance with the locking and unlocking control signals;

an electrical switch coupled to the first locking station and which can be switched when the first locking station is actuated in the unlocking direction; and a switching device which can be activated at least indirectly by the electrical switch and which, after being activated, suppresses at least for a limited period the effect in the central control circuit of the locking control signal generated by the control switch of the first locking station.

10. The central locking system of claim 9, further comprising an engagement device which can be overcome when the first locking station is actuated in the unlocking direction and which forms a pressure point which starts from the neutral key withdrawal position, said engagement device being arranged between the switching point of the first control switch and the switching point of the electrical switch.

11. The central locking system of claim 10, wherein the switching device includes a timing element coupled to the electrical switch and which can be started by the electrical switch, said timing element predetermining, by means of its timing constant, a time period for the suppression of the effect of the locking control signal, said time period following directly after the actuation of the electrical switch.

12. The central locking system of claim 11, containing a control line for transmitting a locking control signal of the control switch of the first locking station into the central control circuit, characterized by a switching contact which is looped into this control line and which is to be opened at first for a limited period by means of the electrical switch.

13. The central locking system of claim 12, wherein the electrical switch is a push-button switch.

14. The central locking system of claim 13, further comprising a relay coil which is activated for a limited period to actuate the switching contact.

15. The central locking system of claim 11, further comprising a start delay circuit which is assigned to the timing element and is activatable by the electrical switch and which only starts the timing element after a certain switch-on duration of the electrical switch has occurred.

16. The central locking system of claim 15, further comprising a further control switch associated with the first locking station, wherein said further control switch is a push-button switch and generates the unlocking control signal and activates the switching device.

17. The central locking system of claim 11, further comprising a further control switch associated with the first locking station, wherein said further control switch is a push-button switch and generates the unlocking control signal and activates the switching device.

18. The central locking system of claim 12, further comprising a start delay circuit which is assigned to the timing element and is activatable by the electrical switch and which only starts the timing element after a certain switch-on duration of the electrical switch has occurred.

19. The central locking system of claim 11, further comprising a signalling line, led from the electrical switch directly to the central control circuit, which transmits a signal that brings about internal suppression of the effect of a locking control signal of the control switch of the first locking station following the actuation of the electrical switch.

20. The central locking system of claim 12, further comprising an engagement device that is actuated mechanically by the lock cylinder to mechanically open the switching contact, the switching contact closing again automatically at least when the key-secured position of the lock cylinder is reached.

21. The central locking system of claim 20, wherein the engagement device includes:

a bistable rocker which can be rocked via corresponding cams by means of the lock cylinder and which switches the electrical switch;

a dead center spring which engages on the rocker eccentrically with respect to a pivot bearing of the rocker and which prestressed the rocker in each case into one of first and second stable positions, the switch being opened in the first position of the rocker and being closed in the second position into which the rocker is unavoidably rocked with the lock cylinder is moved into the key-secured position.

22. The central locking system of claim 13, further comprising an engagement device that is actuated mechanically by the lock cylinder to mechanically open the switching contact, the switching contact closing again automatically at least when the key-secured position of the lock cylinder is reached.

23. The central locking system of claim 22, wherein the engagement device includes:

a bistable rocker which can be rocked via corresponding cams by means of the closing cylinder and which switches the electrical switch;

a dead center spring which engages on the rocker eccentrically with respect to a pivot bearing of the rocker and which prestresses the rocker in each case into one of first and second stable positions, the switch being opened in the first position of the rocker and being closed in the second position into which the rocker is unavoidably rocked when the lock cylinder is moved into the key-secured position.

24. The central locking system of claim 9, further comprising a signalling line, led from the electrical switch directly to the central control circuit, which transmits a signal that brings about internal suppression of the effect of a locking control signal of the control switch of the first locking station following the actuation of the electrical switch.

* * * * *